US005410459A

United States Patent [19]

Yang

[11] Patent Number: 5,410,459

[45] Date of Patent: Apr. 25, 1995

[54] LIGHTING ORNAMENT

[76] Inventor: Ping-Kun Yang, No. 24, Lane 559, Chung Hsiao E. Road, Sec. 4, Taipei, Taiwan, Prov. of China

[21] Appl. No.: 197,289

[22] Filed: Feb. 15, 1994

[51] Int. Cl.[6] ..... F21V 21/00

[52] U.S. Cl. ..... 362/249; 362/252; 362/806; 362/240; 362/238; 362/374; 362/375; 362/267; 362/310

[58] Field of Search ..... 362/252, 806, 237, 457, 362/443, 433, 360, 352, 374, 375, 235, 236, 242, 310, 267, 219, 238, 223, 240

[56] References Cited

U.S. PATENT DOCUMENTS 2,269,182 1/1942 Claspy et al. ..... 362/375 X
3,612,855 10/1971 Juhnke ..... 362/235
4,170,035 10/1974 Walker ..... 362/806 X
4,181,928 1/1980 Zelina ..... 362/236 X
4,303,963 12/1981 Audesse et al. ..... 362/240 X
4,544,996 10/1985 George ..... 362/249 X
4,819,136 4/1989 Ramsey ..... 362/267 X
4,885,664 12/1989 Hermanson ..... 362/806 X
5,038,255 8/1991 Nishihashi et al. ..... 362/373 X

*Primary Examiner*—Ira S. Lazarus
*Assistant Examiner*—Thomas M. Sember
*Attorney, Agent, or Firm*—Michael N. Meller

[57] ABSTRACT

A lighting ornament has a first and a second shell arranged to mesh with each other. One of the shells has a raised portion to form a compartment adapted to receive a string of lights when the shells are meshed. Packing material is arranged on the edge portions of one of the shells so that the chamber is hermetically sealed and fastened by the packing material when the shells are meshed.

5 Claims, 2 Drawing Sheets

LIGHTING ORNAMENT

BACKGROUND OF THE INVENTION

The present invention relates to a lighting ornament which is comprises a bottom shell, a top shell, which when attached to the bottom shell forms a cover, and a light string received between the top and bottom shells.

The type of lighting ornament with which this invention is concerned conventionally comprises a frame made by bending an iron wire into the desired shape, a light string wound on the frame, and flexible plastic sheets winding around the light string and the frame and fastened together in an air-tight manner by an adhesive tape or a bonding agent. This type of lighting ornament is structurally unsuitable for mass production because of its labor-consuming nature. Once assembled, it cannot be unassembled, and therefore the bulbs of the light string are not replaceable. Because the frame of the lighting ornament is made by bending an iron wire into a shaped structure, the lighting ornament will deform when squeezed or twisted. Furthermore, the plastic sheets which wind around the frame and the light string may be subject to breaking apart due to effects of the weather, and water may enter through the gaps formed among the plastic sheets causing tile bulbs of the light string to be damaged.

SUMMARY OF THE INVENTION

It is one object of the present invention to provide a lighting ornament which is easy to assemble and inexpensive to manufacture. It is another object of the present invention to provide a lighting ornament which can be effectively protected against water and moisture. It is still another object of the present invention to provide a lighting ornament which permits the bulbs of the internal light string thereof to be conveniently replaced. It is still another object of the present invention to provide a lighting ornament which does not deform easily.

According to the present invention, the lighting ornament includes a bottom shell, a top shell removably attached to the bottom shell, and a light string disposed in a holding chamber formed in the middle of the top shell along the longitudinal direction thereof and covered by the bottom shell. The top and bottom shells are respectively molded from polyacrylate or similar materials. Elastic packing strips are mounted between the top and bottom shells to seal the gaps.

DETAILED DESCRIPTION OF THE PREFERRED EMBODIMENTS

Figure 1:
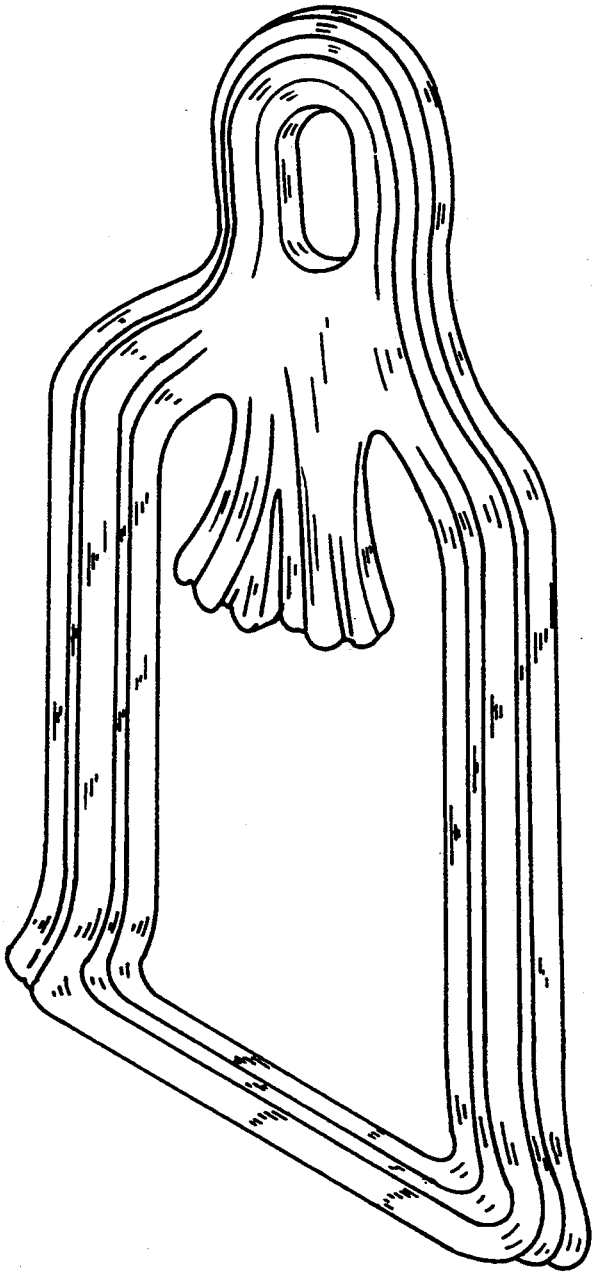
FIG. 1 is an elevational view of a lighting ornament according to the present invention.

Referring to FIG. 1, a lighting ornament 1 is shown of bell-like shape when viewed from the front side. Of course, it can be made in the form of any of a variety of shapes as desired.

Figure 2:
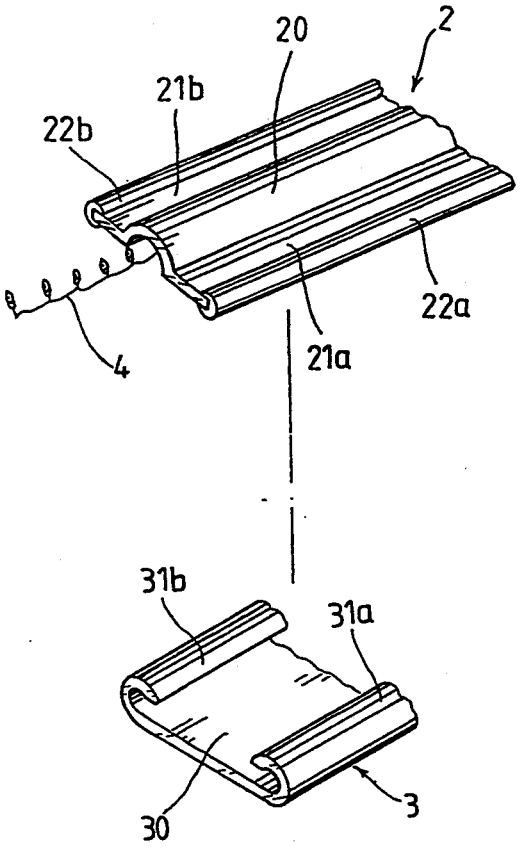
FIG. 2 is an exploded view of the part A shown in FIG. 1.
Figure 3:
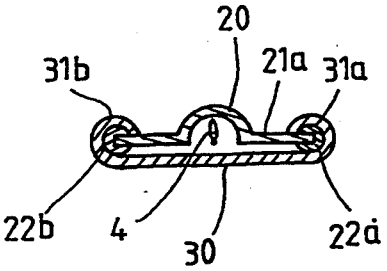
FIG. 3 is a cross section of the part A shown in FIG. 1.

Referring to FIGS. 2 and 3, the lighting ornament 1 comprises a top shell 2, a bottom shell 3, and a light string 4 received between the top and bottom shells. The top and bottom shells 2,3 are respectively molded from polyacrylate or similar materials. The light string is of the type including a plurality of bulbs 42, a plurality of bulb sockets 41 and a conducting cord 40. The top shell 2 comprises a ridge 20 in the middle along the length thereof defining a longitudinal holding chamber on the inside for receiving the light string 4, and two flat mounting portions 21*a*, 21*b* longitudinally connected to the ridge 20 at two opposite sides. The flat mounting portion 21*a* or 21*b* is covered with a respective elastic packing strip 22*a* or 22*b* along the edge. The elastic packing strip 22*a* or 22*b* may be made of rubber or any suitable elastic plastics. The bottom shell 3 comprises a base plate 30 having two opposite side edges curved upwards and then extended inwards to form two 31*a*,31*b* for receiving the flat mounting portions 21*a*, 21*b*. The distance between the bottoms of the recesses 31*a*, 31*b* is slightly shorter than the width of the top shell 2 (the combined width of the ridge 20 and the mounting portions 21*a*, 21*b* together with the elastic packing strips 22*a*, 22*b*). By bending the two mounting portions 21*a*, 21*b* inwards, the two mounting portions 21*a*, 21*b* (with the elastic packing strips 22*a*, 22*b*) can be conveniently inserted into the recesses 31*a*, 31*b* of the bottom shell 3 When the top shell 2 is released from bending after the insertion, it immediately returns to its original shape and is retained in place by the recesses 31*a*,31*b*. Because the top shell 2 is wider in width than the bottom shell 3, the elastic packing strips 22*a*,22*b*, after the lighting ornament 1 is assembled, are respectively pressed by both the reccess 31*a*, 31*b* and the base plate 30 so that the inner space defined by the top shell 2 and the bottom shell 3 is tightly sealed by such. Therefore, water is prohibited from entering the lighting ornament 1.

Figure 4:
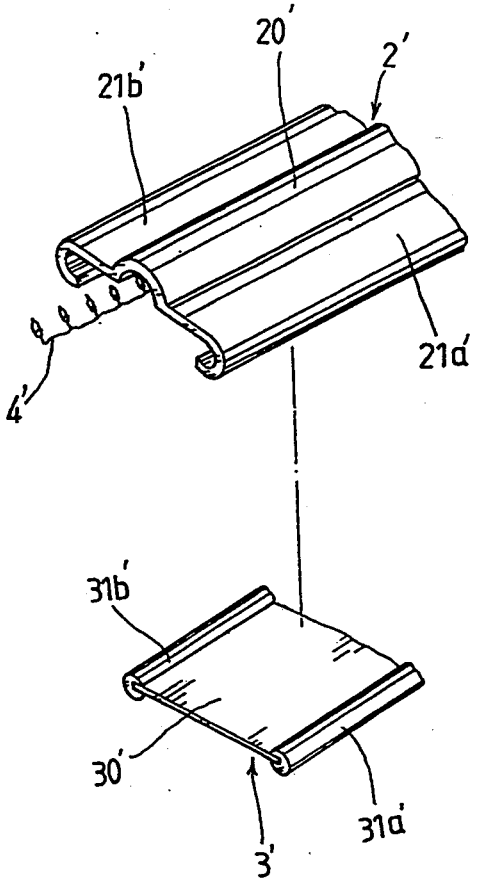
FIG. 4 is a partial exploded view of an alternate form of the present invention.
Figure 5:
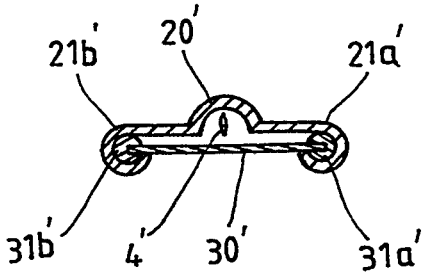
FIG. 5 is an assembly view in section of the alternate form of FIG. 4.

Referring to FIGS. 4 and 5, therein illustrated shows an alternate form of the present invention. According to this alternate form, the top shell 2' comprises a ridge 20' in the middle along the length thereof defining a longitudinal holding chamber on the inside for receiving a light string 4', and two opposite long sides 21*a'*, 21*b'* respectively curved downwards and then inwards and terminating in two inward bottom recesses 22*a'*, 22*b'*. When assembled, the two clastic packing strips 31*a'*, 31*b'* are inserted into the recesses 22*a'*, 22*b'* of the top shell 2', and therefore the inner space defined by the top and bottom shells 2', 3' are tightly sealed.

While only two embodiments of the present invention have been shown and described, it will be understood that various modifications and changes could be made without departing from the spirit and scope of the invention. For example: the top or bottom shell may be made transparent or colored, or attached with reflector strips or decorative strips.

What is claimed is:

1. A lighting ornament comprising:

a first shell having a first longitudinal axis and being substantially planar in shape, said shell having a raised portion along said first longitudinal axis and two edge portions spaced from each other by a first distance and being substantially parallel to said first longitudinal axis;

a second shell having a second longitudinal axis and being substantially planar in shape, said second shell having edge portions spaced from each other by a second distance and being substantially parallel to said second longitudinal axis; and elastic packing members arranged along said edge portions of one of said first and second shells while said edge portions of the other of said first and second shells are curved towards said longitudinal axis thereof and are adapted to receive said edge portions and said packing members of said one shell whereby when said first and second shells are arranged with said first and second longitudinal axes substantially parallel and adjacent each other said raised portion of said first shell forms a chamber adapted to receive and enclose a string of lights to form said lighting ornament, while said elastic packing members fasten said shells together and seal said chamber hermetically.

2. A lighting ornament as claimed in claim 1, wherein said edge portions of said first shell have said packing members arranged thereon while said edge portions of said second shell are curved towards said second longitudinal axis.

3. A lighting ornament as claimed in claim 2, wherein said first distance between said edge portions of said first shell is longer than said second distance between said edge portions of said second shell.

4. A lighting ornament as claimed in claim 1, wherein said edge portions of said second shell have said packing material arranged thereon while said edge portions of said first shell are curved towards said first longitudinal axis.

5. A lighting ornament as claimed in claim 4, wherein said second distance between said edge portions of said second shell is longer than said first distance between said edge portions of said first shell.

* * * * *